US009625143B2

(12) United States Patent
Hsu

(10) Patent No.: US 9,625,143 B2
(45) Date of Patent: Apr. 18, 2017

(54) TOOL BOX WITH ILLUMINATION UNIT

(71) Applicant: Shao-Hsien Hsu, Taichung (TW)

(72) Inventor: Shao-Hsien Hsu, Taichung (TW)

( * ) Notice: Subject to any disclaimer, the term of this patent is extended or adjusted under 35 U.S.C. 154(b) by 477 days.

(21) Appl. No.: 14/464,676

(22) Filed: Aug. 20, 2014

(65) Prior Publication Data

US 2016/0053987 A1 Feb. 25, 2016

(51) Int. Cl.

| | |
|---|---|
| ***F21V 33/00*** | (2006.01) |
| ***B65D 25/10*** | (2006.01) |
| ***B25H 3/02*** | (2006.01) |
| ***B65D 43/16*** | (2006.01) |
| ***F21V 23/04*** | (2006.01) |
| ***B25H 3/00*** | (2006.01) |

(52) U.S. Cl.

CPC ..... *F21V 33/0084* (2013.01); *B25H 3/003* (2013.01); *B25H 3/02* (2013.01); *B65D 25/105* (2013.01); *B65D 25/108* (2013.01); *B65D 43/16* (2013.01); *F21V 23/04* (2013.01); *F21V 33/008* (2013.01)

(58) Field of Classification Search

CPC .... F21V 33/0084; F21V 33/008; F21V 23/04; B25H 3/003; B25H 3/02; B65D 25/108

See application file for complete search history.

(56) References Cited

U.S. PATENT DOCUMENTS

| | | | | |
|---|---|---|---|---|
| 5,440,458 | A * | 8/1995 | Volk | F21V 33/0068 206/5.1 |
| 5,690,231 | A * | 11/1997 | Erickson | B44C 3/06 206/232 |
| 6,270,233 | B1 * | 8/2001 | Holland | A47J 47/18 362/154 |
| 6,360,891 | B1 * | 3/2002 | Rideout | B25H 3/00 206/372 |
| 6,693,537 | B2 * | 2/2004 | Frank | A47G 29/08 206/438 |
| 8,851,283 | B2 * | 10/2014 | Wu | A47G 7/06 206/234 |
| 8,997,995 | B2 * | 4/2015 | Chitsazan | B65D 25/2858 206/541 |
| 9,399,283 | B2 * | 7/2016 | Redrick | B25H 3/022 |
| 2006/0082466 | A1 * | 4/2006 | Drake | B25H 3/003 340/686.1 |
| 2008/0035507 | A1 * | 2/2008 | Collister | B25H 3/006 206/349 |
| 2011/0056858 | A1 * | 3/2011 | Benczkowski | B25H 3/06 206/338 |
| 2015/0258678 | A1 * | 9/2015 | Wang | B25H 3/06 206/378 |

* cited by examiner

*Primary Examiner* — Christopher Harmon
(74) *Attorney, Agent, or Firm* — Rosenberg, Klein & Lee

(57) ABSTRACT

A tool box includes a box with a base and a cover. A positioning member is located in the reception recess of the base and has multiple insertion holes. Each insertion hole is cooperated with a bit type indication which is light permeable. A back-light plate is located between the inside of the reception recess and the positioning member. A light source is located on one of sidewalls of the reception recess. The back-light plate changes paths of light beams generated from the light source toward the bit type indications so that the bit type indications are illuminated when the cover is opened.

7 Claims, 7 Drawing Sheets

TOOL BOX WITH ILLUMINATION UNIT

BACKGROUND OF THE INVENTION

1. Fields of the Invention

The present invention relates to a tool box, and more particularly, to a tool box with an illumination unit for showing the bits sizes and types in dark area.

2. Descriptions of Related Art

The conventional tool box usually provide multiple slots or holes for accommodating bits and parts, so that the user can choose the correct one from the tool box.

Another tool box is compact and is designed to carry bits and smaller parts. The compact tool box is easily carried and light in weight so that the user can carry the compact tool box with him/her. In order to allow the user to quickly pick the correct bit, the tool box has a positioning member located therein and the positioning member has multiple holes so as to accommodate the bits. A mark is provided beside each hole to disclose the size and/or type of the bit.

However, the mark is painted by paint which can easily be removed after frequent scratches, so that the user cannot distinguish the size and type if the tool box is used in a dark area.

The present invention intends to provide a tool box which eliminates the shortcomings mentioned above.

SUMMARY OF THE INVENTION

The present invention relates to a tool box and comprises a box having a base and a cover. The base has a reception recess defined therein. The cover is pivotably connected to the first side of the base so as to cover the reception recess. A positioning member is located in the reception recess and has multiple insertion holes defined in the top thereof. Multiple bit type indications are defined in the top of the positioning member and respectively located corresponding to the insertion holes. The bit type indications each are light permeable. An illumination unit is located in the reception recess and has a back-light plate and a light source. The back-light plate is located between the inside of the reception recess and the positioning member. The light source is located on one of sidewalls of the reception recess. The back-light plate changes paths of light beams generated from the light source and guides the light beams toward the bit type indications.

Preferably, the bit type indications are defined through the top of the positioning member.

Preferably, the base has a recessed area defined in the outside of the second side thereof and a touch switch is connected to the inside of the recessed area. The touch switch is electrically connected to the light source. The cover has a contact plate which touches the touch switch to cut off the electrical connection between the touch switch and the light source when the cover covers to the base. The electric connection between the touch switch and the light source is re-connected when the cover is opened and the touch plate is separated from the touch switch.

Preferably, a power switch is connected to the outside of the base or an outside of the cover. The power switch is electrically connected to the light source.

Preferably, a size indication is located beside the bit size indication of each insertion hole.

Preferably, the insertion holes are located on one side of the top of the positioning member. Two clip plates extend from the other side of the top of the positioning member. A space is defined between the two clip plates. Two positioning plates extend from the top of the positioning member and each positioning plate has a notch defined in the top edge thereof. The two clip plates are located between the two positioning plates.

The primary object of the present invention is to provide a tool box wherein the size and type indications of the bits can be illuminated when the cover is operand.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
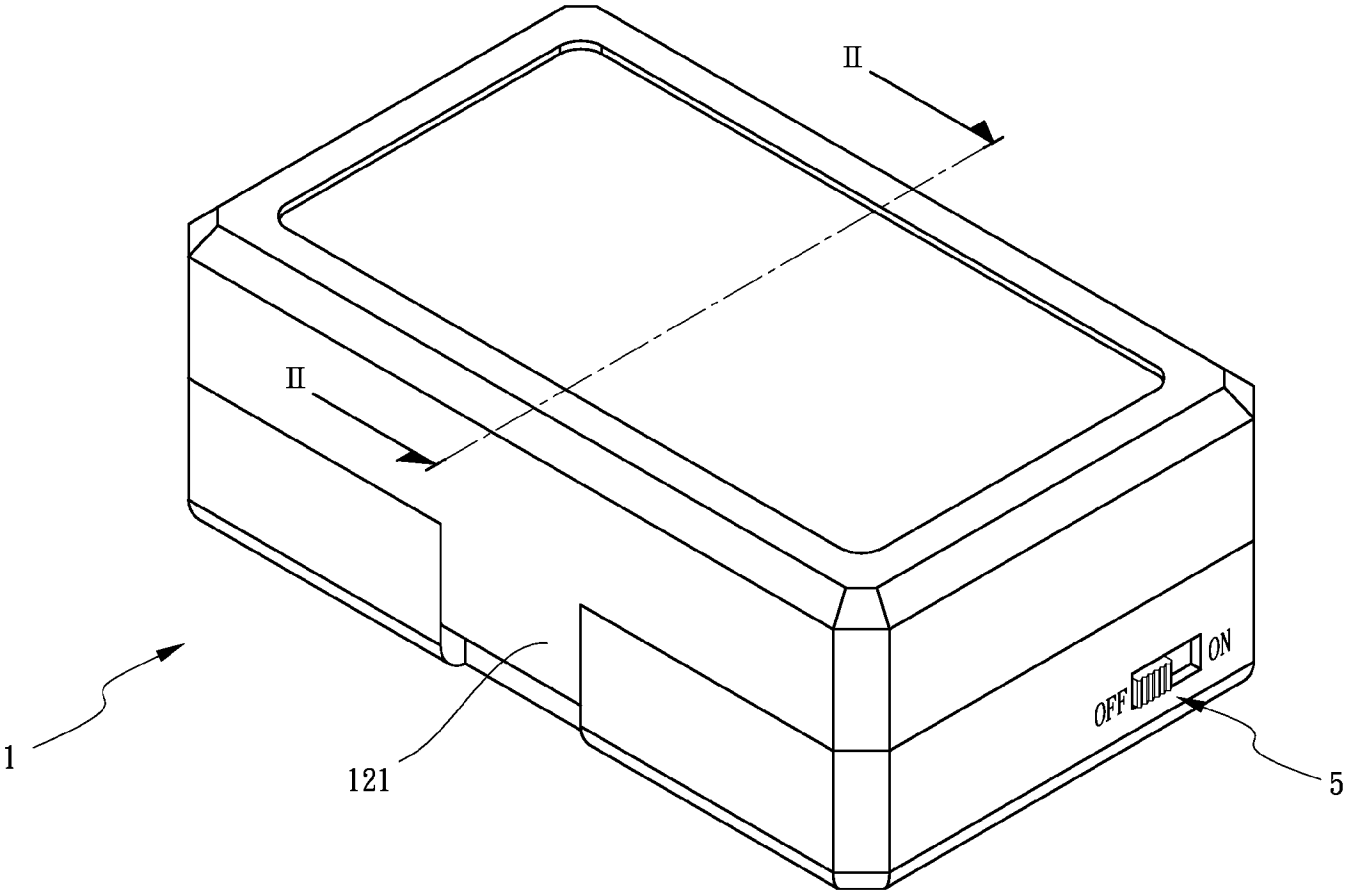
FIG. 1 is a perspective view to show the tool box of the present invention.
Figure 2:
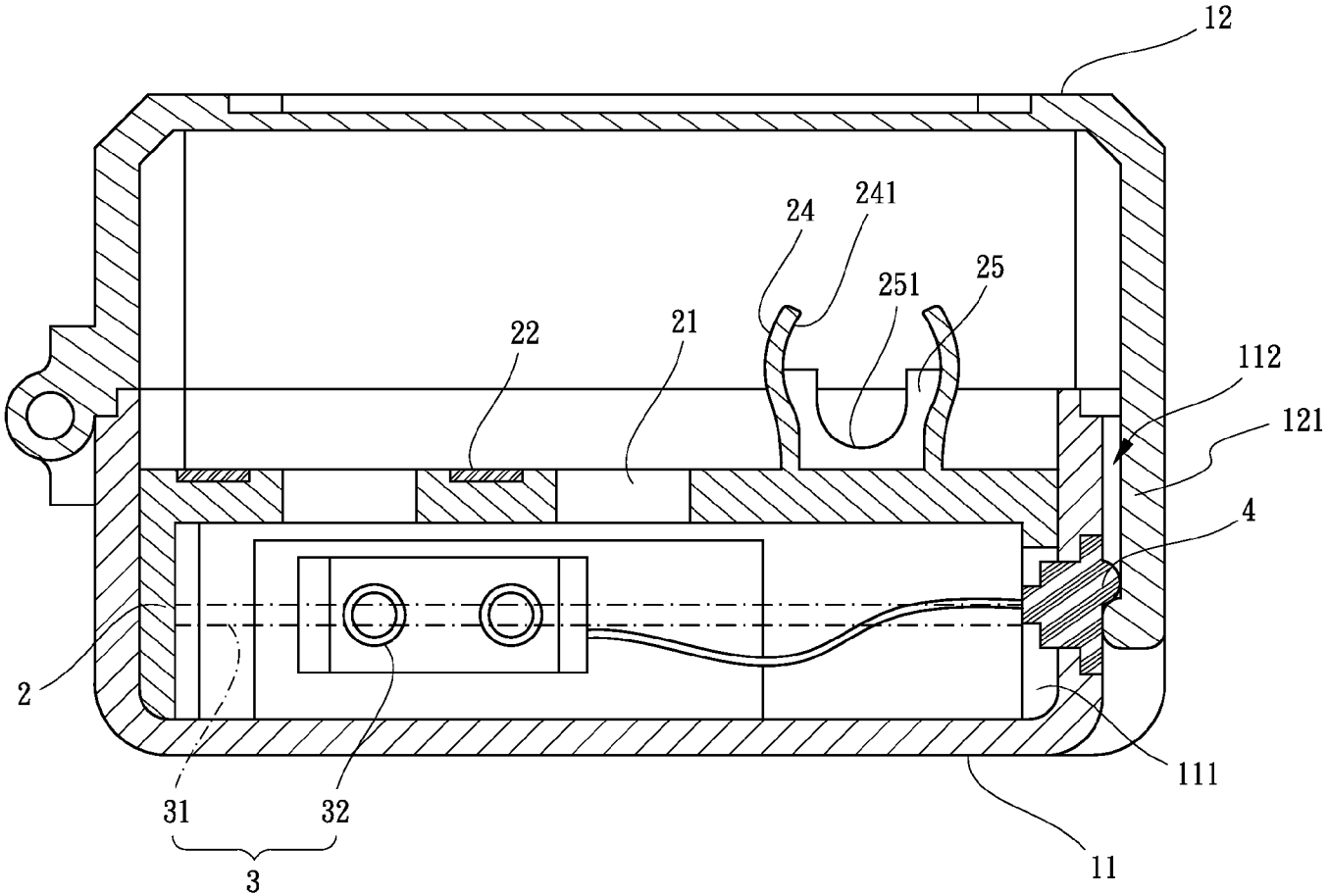
FIG. 2 is a cross sectional view, taken along ling A-A in FIG. 1.
Figure 3:
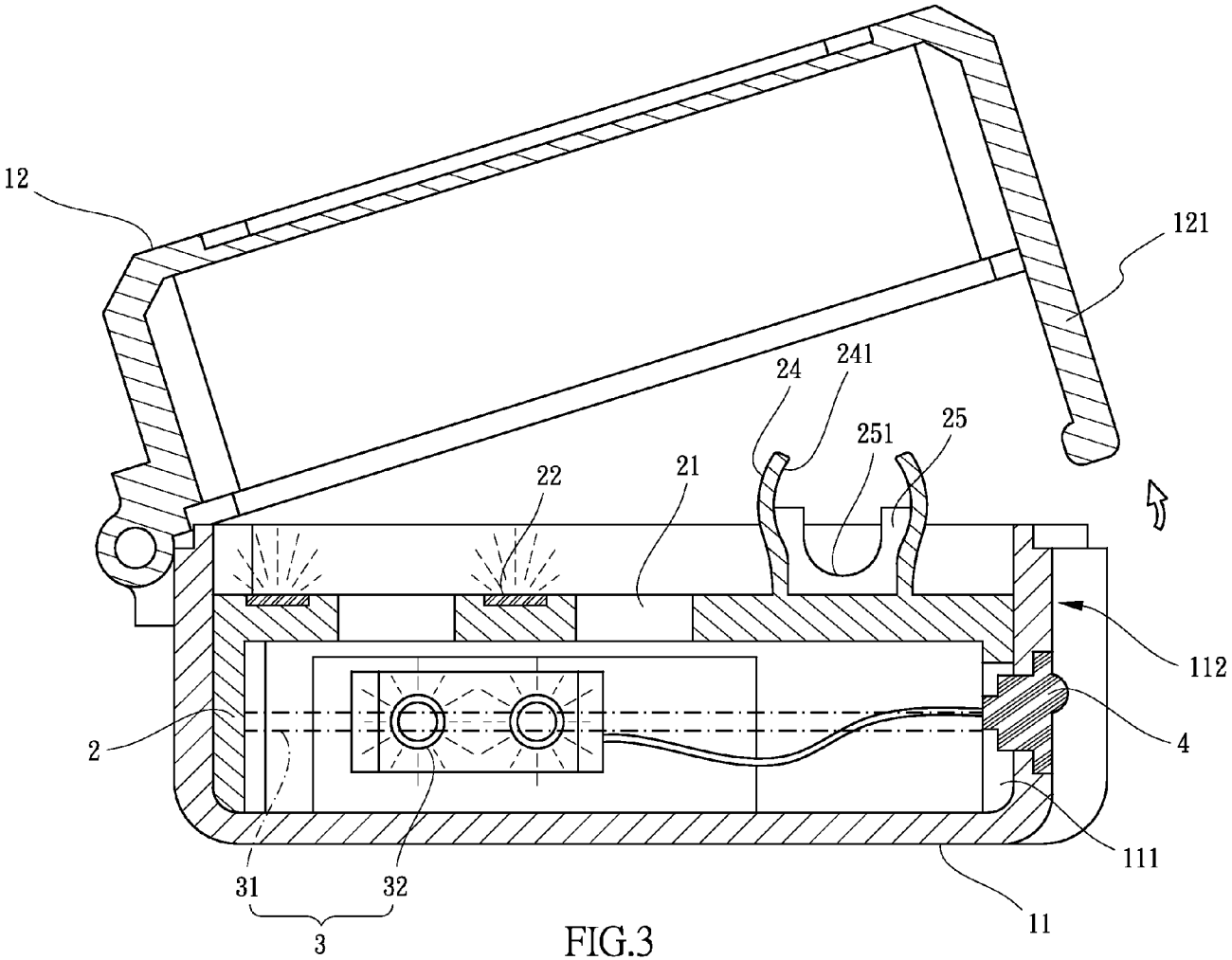
FIG. 3 is a cross sectional view to show the illumination unit is activated when the cover is opened.

Referring to FIGS. 1 to 4, the tool box of the present invention comprises a box 1 which has a base 11 and a cover 12. The base 11 has a reception recess 111 defined therein and a positioning member 2 is located in the reception recess 111. The positioning member 2 has multiple insertion holes 21 defined in the top thereof so as to accommodate bits 10 therein. The cover 12 is pivotably connected to the first side of the base 11 so as to cover the reception recess 111. Multiple bit type indications 22 are defined in the top of the positioning member 2 and respectively located corresponding to the insertion holes 21. The bit type indications 22 each is light permeable.

An illumination unit 3 is located in the reception recess 111 and has a back-light plate 31 and a light source 32. The back-light plate 31 is located between the inside of the reception recess 111 and the positioning member 2. The light source 32 is located on one of sidewalls of the reception recess 111. The back-light plate 31 changes paths of light beams generated from the light source 32 and guides the light beams toward the underside of the bit type indications 22 so that the bit type indications 22 are illuminated and the users can easily distinguish the bit types. By the illumination unit 3 and the light permeable bit type indications 22, the users can easily pick the correct bit 10 and put the bit 10 back correctly.

The base 11 has a recessed area 112 defined in the outside of the second side thereof and a touch switch 4 is connected to the inside of the recessed area 112. The touch switch 4 is electrically connected to the light source 32. The cover 12 has a contact plate 121 which extends from the cover 12 and touches the touch switch 4 to cut off the electrical connection between the touch switch 4 and the light source 32 when the cover 12 covers to the base 11. Alternatively, the electric connection between the touch switch 4 and the light source 32 is re-connected when the cover 12 is opened and the touch plate 121 is separated from the touch switch 4.

Figure 5:
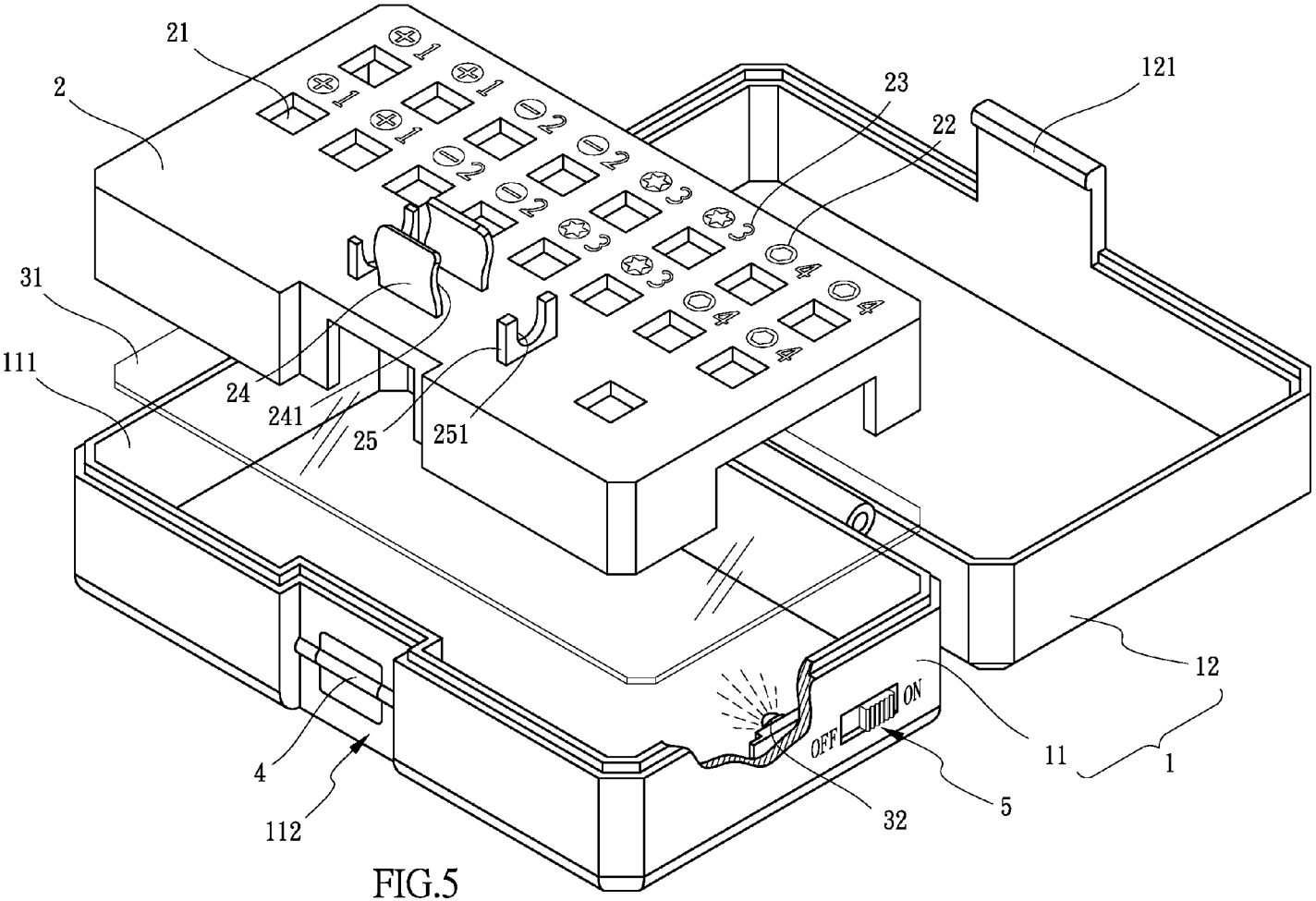
FIGS. 5 and 6 respectively show the operation of the power switch to turn on and to turn off the illumination unit.
Figure 6:
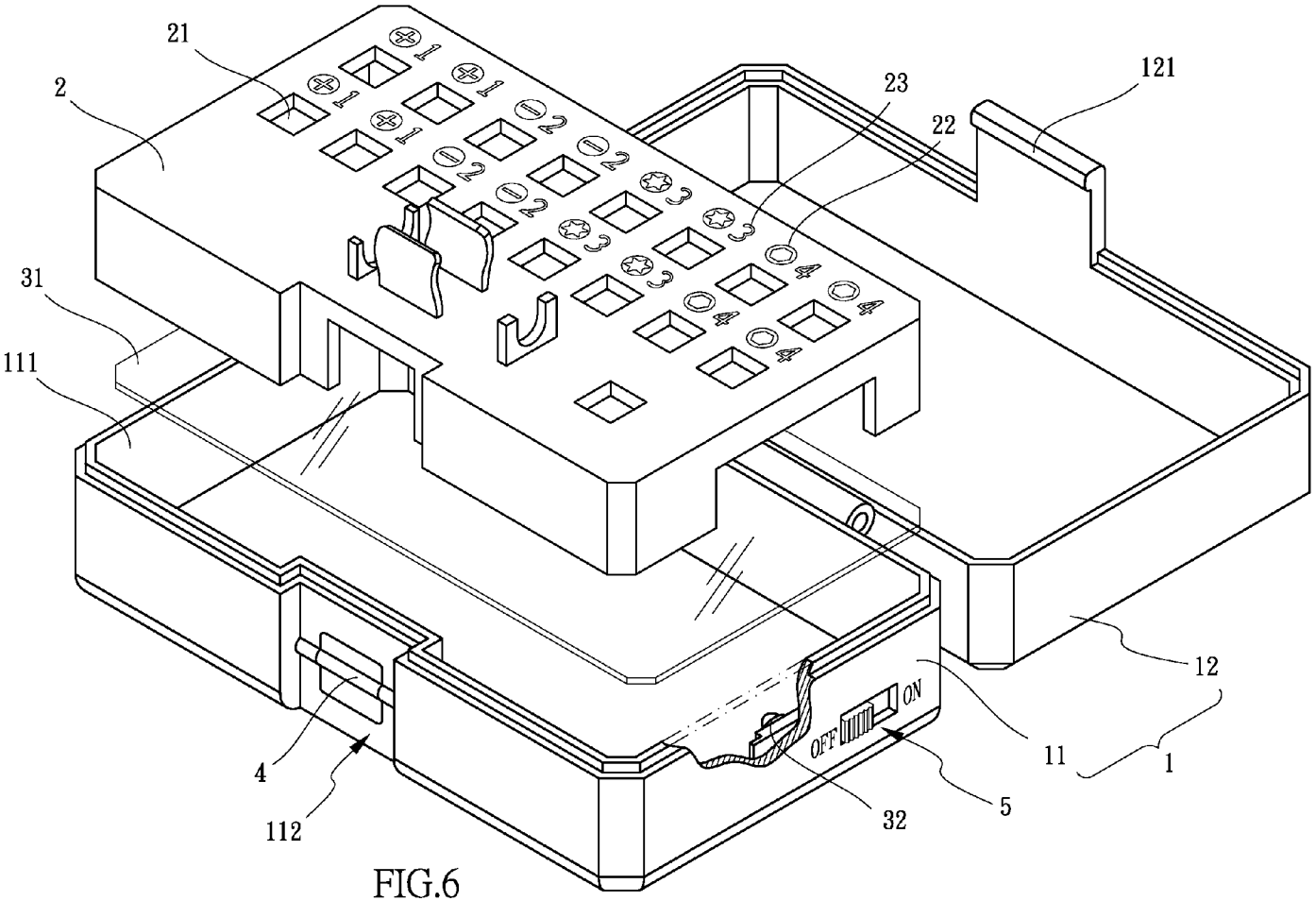

As shown in FIGS. 5 and 6, the other way that the user can activate the illumination unit 3 is that a power switch 5 is connected to the outside of the base 11 or to the outside of the cover 12. The power switch 5 is electrically connected to the light source 32 so that the user can switch the button of the power switch 5 to activate the illumination unit 3. When the cover 12 is positioned at the open position for a period of time, the user can turn off the illumination unit 3 by switching the button of the power switch 5.

Figure 7:
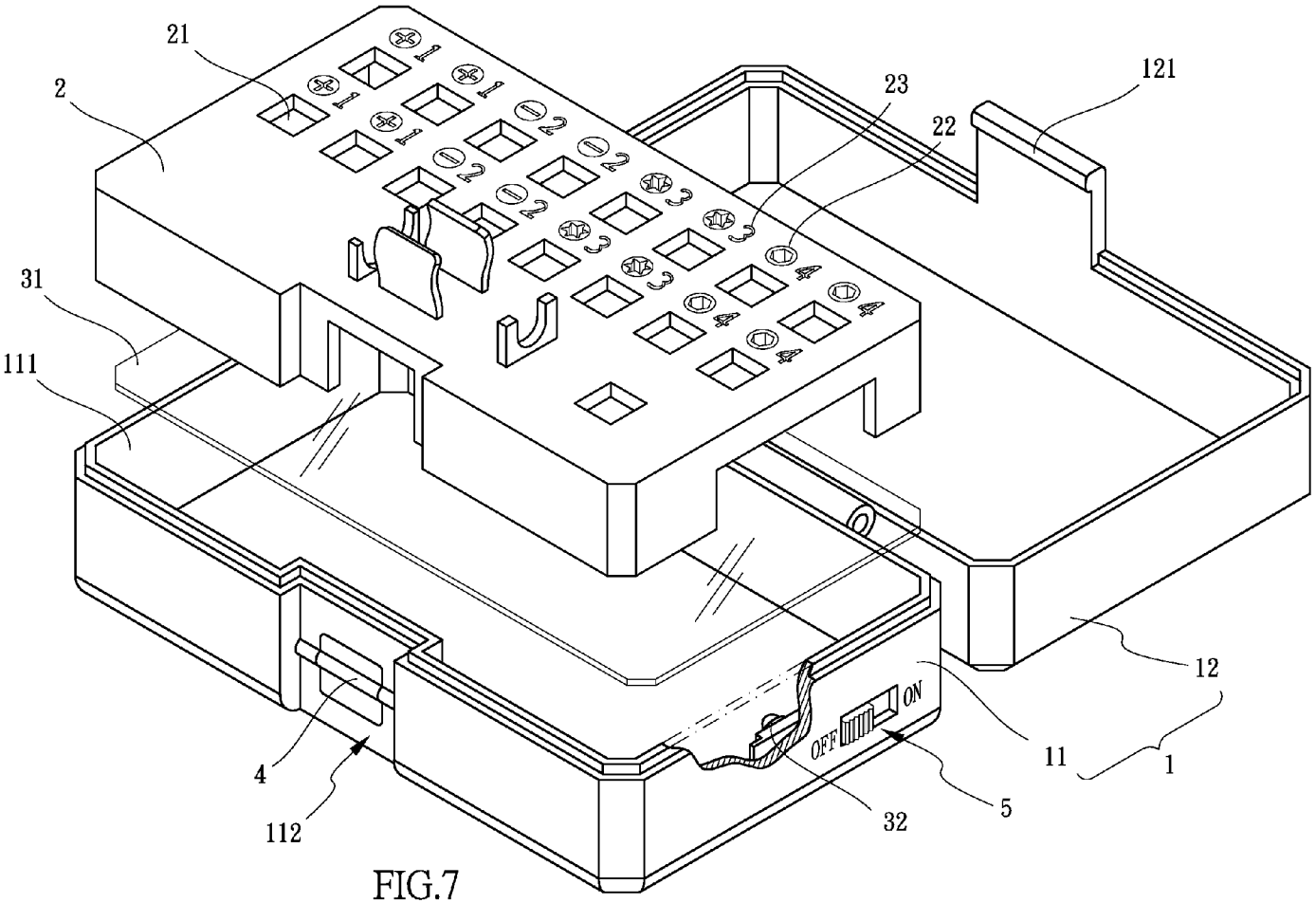
FIG. 7 shows another embodiment of the present invention wherein the bit type indications are defined through the positioning member.

There is a size indication 23 located beside the bit size indication 22 of each insertion hole 112. The size indications 23 are also light permeable as the bit size indications 22. Alternatively, the bit type indications 22 and the size indications 23 are defined through the positioning member 2 so that the light can pass through the bit type indications 22 and the size indications 23 as shown in FIG. 7.

Figure 4:
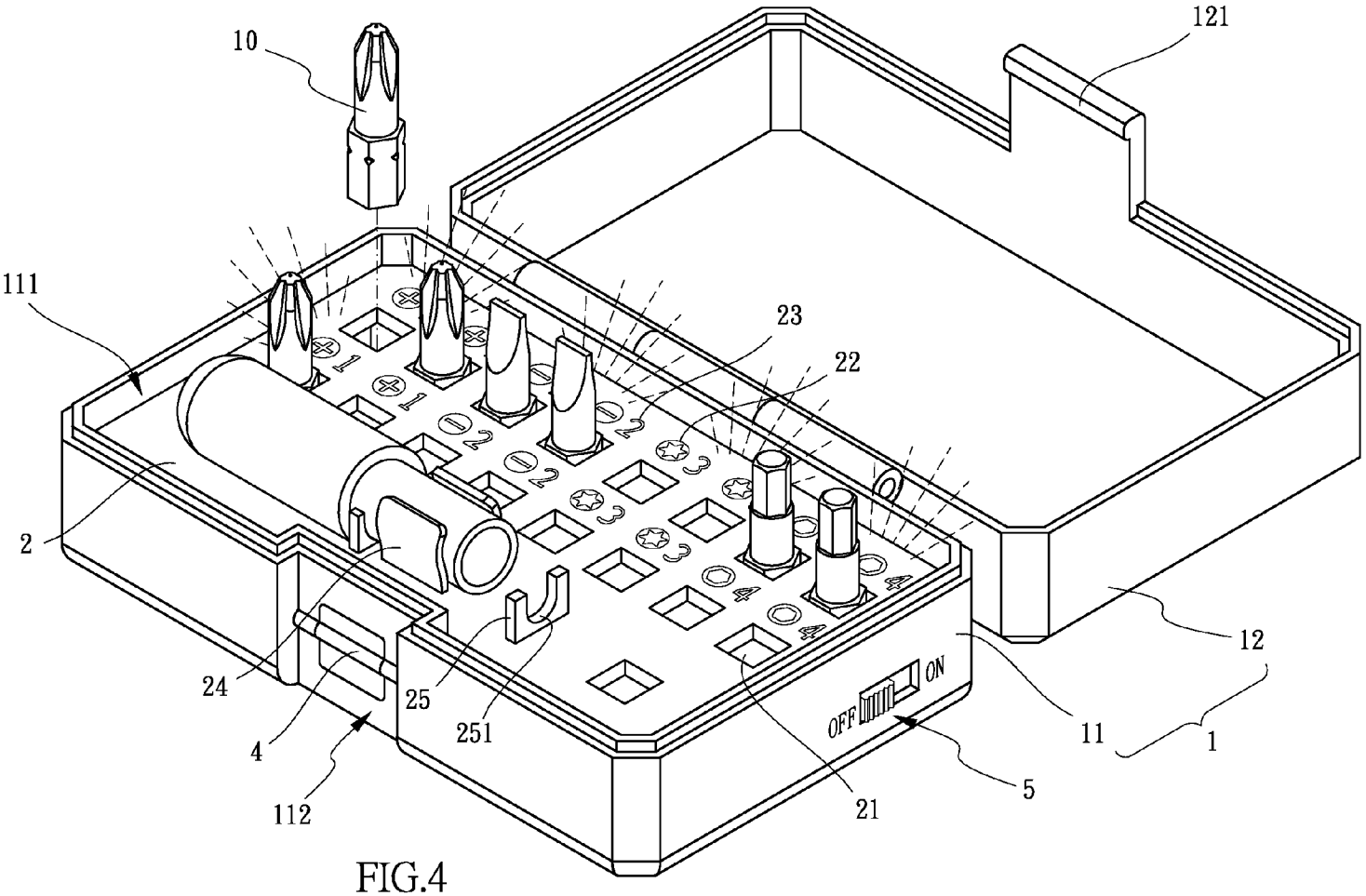
FIG. 4 is a perspective view to show that the bit type indications and the size indications are illuminated by the illumination unit of the tool box of the present invention.

The insertion holes 112 are located on one side of the top of the positioning member 2, and two clip plates 24 extend from the other side of the top of the positioning member 2. A space 241 is defined between the two clip plates 24. Two positioning plates 25 extend from the top of the positioning member 2 and each positioning plate 25 has a notch 251 defined in the top edge thereof. The two clip plates 24 are located between the two positioning plates 25. A connection rod or other part as shown in FIG. 4 is clamped in the space 241 between the two clip plates 24, and a portion of the connection rod is supported by the notch 251 of one of the positioning plates 25. It the connection rod is a long part, the two ends of the connection rod can be supported and positioned by the two notches 251 of the two positioning plates 25.

While we have shown and described the embodiment in accordance with the present invention, it should be clear to those skilled in the art that further embodiments may be made without departing from the scope of the present invention.

What is claimed is:

1. A tool box comprising:

a box having a base and a cover, the base having a reception recess defined therein, the cover pivotably connected to a first side of the base so as to cover the reception recess;

a positioning member located in the reception recess and having multiple insertion holes defined in a top thereof, multiple bit type indications defined in the top of the positioning member and respectively located corresponding to the insertion holes, the bit type indications each being light permeable, and an illumination unit located in the reception recess and having a back-light plate and a light source, the back-light plate located between an inside of the reception recess and the positioning member, the light source located on one of sidewalls of the reception recess, the back-light plate changing paths of light beams generated from the light source and guiding the light beams toward the bit type indications.

2. The tool box as claimed in claim 1, wherein the bit type indications are defined through the positioning member.

3. The tool box as claimed in claim 1, wherein the base has a recessed area defined in an outside of a second side thereof and a touch switch is connected to an inside of the recessed area, the touch switch is electrically connected to the light source, the cover has a contact plate which touches the touch switch to cut off an electrical connection between the touch switch and the light source when the cover covers to the base, the electric connection between the touch switch and the light source is re-connected when the cover is opened and the touch plate is separated from the touch switch.

4. The tool box as claimed in claim 2, wherein the base has a recessed area defined in an outside of a second side thereof and a touch switch is connected to an inside of the recessed area, the touch switch is electrically connected to the light source, the cover has a contact plate which touches the touch switch to cut off an electrical connection between the touch switch and the light source when the cover covers to the base, the electric connection between the touch switch and the light source is re-connected when the cover is opened and the touch plate is separated from the touch switch.

5. The tool box as claimed in claim 1, wherein a power switch is connected to the outside of the base or an outside of the cover, the power switch is electrically connected to the light source.

6. The tool box as claimed in claim 1, wherein a size indication is located beside the bit size indication of each insertion hole.

7. The tool box as claimed in claim 1, wherein the insertion holes are located on one side of the top of the positioning member, two clip plates extend from the other side of the top of the positioning member, a space is defined between the two clip plates, two positioning plates extend from the top of the positioning member and each positioning plate has a notch defined in a top edge thereof, the two clip plates are located between the two positioning plates.

* * * * *